United States Patent [19]

Duc

[11] Patent Number: 4,479,310

[45] Date of Patent: Oct. 30, 1984

[54] CONTINUOUS DEHYDRATION DEVICE AND PROCESS

[76] Inventor: François Duc, "La Sabatiere", 24100 Bergerac, France

[21] Appl. No.: 409,730

[22] Filed: Aug. 20, 1982

[30] Foreign Application Priority Data

Sep. 3, 1981 [FR] France ..... 81 16746

[51] Int. Cl.[3] ..... F26B 3/04

[52] U.S. Cl. ..... 34/34; 34/66; 34/207; 34/216

[58] Field of Search ..... 34/203, 207, 208, 213, 34/216, 66, 224, 34, 33, 54; 421/443; 99/483

[56] References Cited

U.S. PATENT DOCUMENTS

| | | | |
|---|---|---|---|
| 1,723,917 | 8/1929 | Buck | 34/85 |
| 2,109,704 | 3/1938 | Morrill | 34/48 |
| 2,284,838 | 6/1942 | Oholm | 34/213 |
| 4,409,744 | 10/1983 | Sturgeon et al. | 34/208 |

*Primary Examiner*—Larry I. Schwartz
*Attorney, Agent, or Firm*—Owen, Wickersham & Erickson

[57] ABSTRACT

Device for the continuous dehydration of products of the type comprising a stack of endless belts, travelling in alternate directions, characterized in that, on the one hand, only one (33) of the ducts (33, 34) is provided with a heating means (14) and with a fresh air intake (32), and in that, on the other hand, at each belt level (1, 2, 3, 4 or 5) there is distributed a mixture of a portion of air coming from the circuit with reheating through a first opening (20, 21, 22, 23 or 24) and another portion of air coming from the circuit without reheating through a second opening (27, 28, 29, 30 or 31), the ratio of cross-sections between the first and the second opening being progressively variable and constantly diminishing from the top level (1) down to the bottom level (5).

9 Claims, 2 Drawing Figures

CONTINUOUS DEHYDRATION DEVICE AND PROCESS

The invention relates to the dehydration of products, notably perishable agricultural produce such as fruits.

Apart from conventional dehydration on trays a continuous dehydration process is also known in which the fruit travels on endless belts in a dehydration tunnel traversed by a flow of hot air, a number of belts being placed one above the other with their ends alternately offset and their direction of travel alternating so that at each end of a belt the fruit falls onto the belt just below which is moving in the opposite direction, and so on. Generally the belts are made up of metal mesh so as to themselves form fruit trays and allow through the hot air flow; this is normally blown into the space between the two forward and return sides of each endless belt so that it is forced to pass through the fruit bed at each level.

This method cuts down on fruit handling and does away with tray handling operations, but it must be conducted with care to prevent the fruit from coming out damaged by excessive heating or, on the contrary, not adequately dehydrated. In order to facilitate this control and regulation of the temperatures at the level of the different belts, there is a known process, notably according to U.S. Pat. No. 1,723,917, recycling part of the air leaving each end of the tunnel through two separate circuits each containing its own blower and its own air heater, and blowing the air thus heated via one of these circuits into the belts of the upper section, whilst the air heated in the other circuit is injected into the belts in the lower section. This makes it possible to separately set the air temperatures involving the belts of the upper group and those of the lower group by acting separately on the two air heaters, for example using thermostats. Such a device is relatively complex however and consumes a significant amount of energy to heat the two air heaters. Furthermore it is not truly progressive since the different belts in the same group are all supplied with air at the same temperature, even though the drying conditions of the fruit they are carrying have already changed to a significant extent from the first to the last belt of the same group.

The aim of the invention is to simplify the system and to make more savings in heating energy whilst providing a more progressive distribution of the temperatures at the levels of the different belts.

The invention consists in dividing the stream of air leaving the two ends of the belt into two parts, as in the system which has just been recapitulated, with a blower or a fan for each of these parts, but only providing for the air heater in one of these parts; the two streams of air thus collected and put back into circulation, one of which only is reheated, are blown in variable proportions in at the level of each belt by means of openings of a size diminishing from top to bottom for the output of the reheated recycled air stream and openings of a size increasing from top to bottom for the recycled air stream which is not reheated. Partial addition of fresh air into the recycled air preferably takes place only in the heated part and upstream of the air heater, and removal of the corresponding portion of unrecycled hot air preferably takes place through the passage opening of the first belt through which the fruit is introduced into the appliance and perhaps, to a lesser extent, through the passage opening of the discharge belt.

The portion of recycled air taken up on the side of the intake belt is preferably collected by lateral vertical ducts circumventing this intake belt.

The whole unit is controlled by action on the single heating means, on the belt speed and, if necessary, by adjusting the cross-sections of the passages for blowing the two recycled air streams in at each level.

Other features of the invention will be revealed in the following description of an embodiment taken as an example and shown in the appended drawings, in which.

Figure 1:
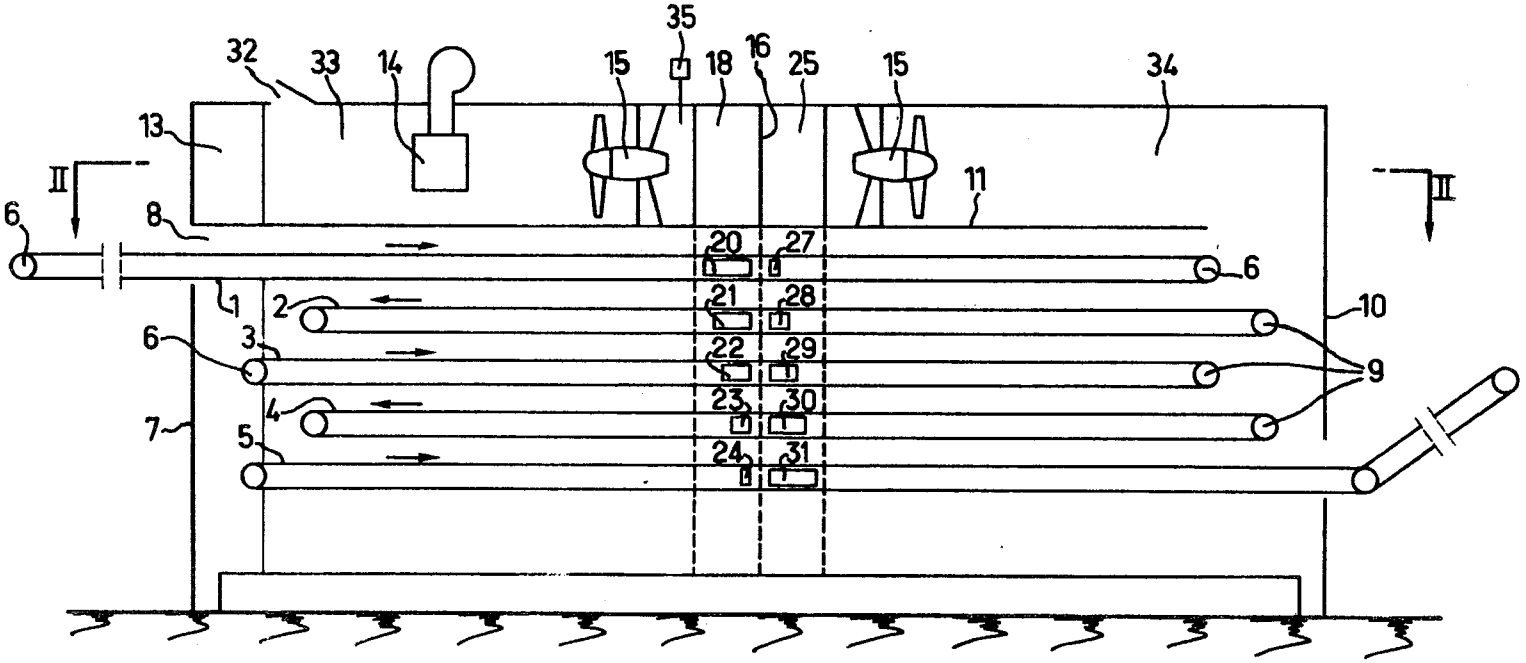
FIG. 1 is a schematic longitudinal section of the whole installation.

The system comprises a series of endless belts one above the other 1, 2, 3, 4 and 5 each preferably formed by transverse bars made of metal sections, for example angles, fixed at each end to two side chains which are returned over end sprockets 6.

In a manner which is usual the direction of travel of these various belts is reversed from one level to the other and each point of discharge from the end of a belt is offset with respect to the starting point of the next belt below so that the fruit is picked up. The intake belt 1 preferably extends outside the body 7 of the appliance and passes through the appliance wall 7 through an opening 8. Similarly the bottom belt 5 extends outside the appliance by leaving through another opening 9 made in the wall 10 of the appliance, which is preferably the wall opposite wall 7. To this end there is preferably an odd number of belts.

Figure 2:
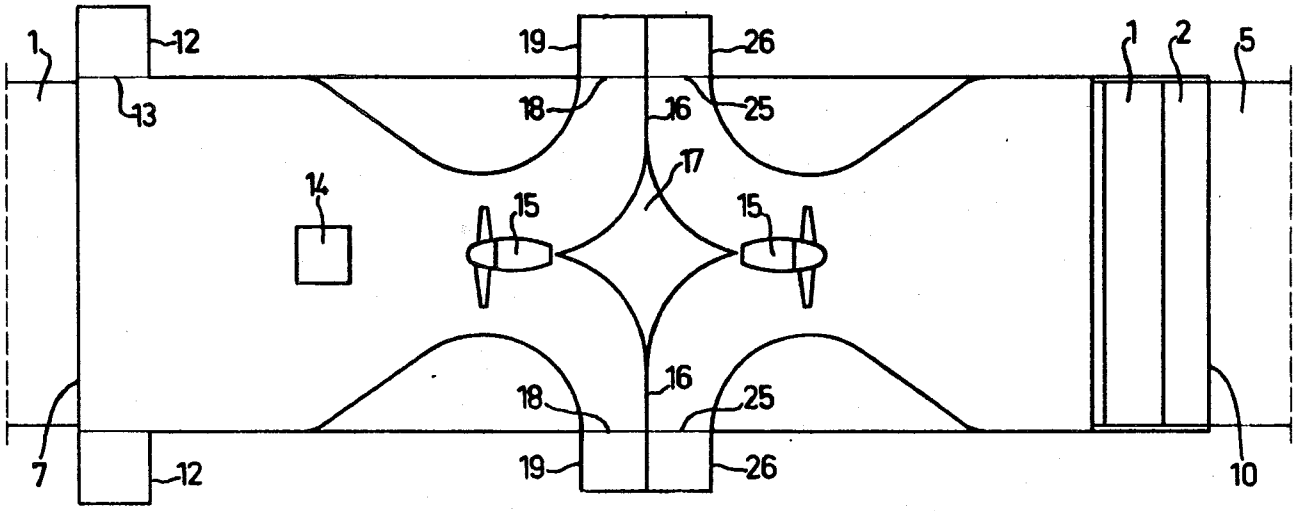
FIG. 2 is a horizontal section along II—II in FIG. 1.

Above the first belt 1 a top partition 11 is placed which preferably extends to the edge of opening 8, and the air arriving at the end of the appliance against wall 7 is collected by two lateral vertical ducts 12, shown in FIG. 2, which open out at 13 into the appliance body above partition 11, after having circumvented belt 1, as shown in FIG. 1.

This air is reheated by an air heater 14 and then recirculated by a blower 15 and from there it meets a dividing partition 16, which may be fitted with a deflector core 17 which forces it to leave through other side openings 18 for other lateral vertical ducts 19 which distribute it at the level of each belt through openings 20, 21, 22, 23 and 24.

At the same time the air arriving at the other end of the appliance, near wall 10, is naturally removed upwards circumventing the end of partition 11, where it is collected by another blower 15 and sent in the same way through side openings 25 into lateral vertical ducts 26, separated from the previous ones, which distribute it to the various levels through openings 27, 28, 29, 30 and 31.

The air can only be partially recycled, which means constantly removing a portion of the hot air that has passed over the fruit. This takes place quite naturally via opening 8 through which the fruit arrives, which has the effect of also contributing to heating and drying this fruit coming in at the intake. Accessorily a small portion of this air can also escape via opening 9, but this must be as small as possible.

In order to make up for this partial removal of the air stream a corresponding stream of fresh air must be taken in from the outside, which is done through an opening 32 located only in the top duct 33 containing the air heater 14; the other top duct 34, located above partition 11 and on the other side of partion 16 therefore has neither an air heater nor a fresh air opening.

This feature thus permits the equipment to be simplified and heating energy to be economized.

Moreover, according to a basic feature of the invention, at each belt level, in the space between the two sides of the belt in a normal manner, or again above this belt, part of the reheated air stream and part of the unreheated air stream are mixed together; the proportions of this mixing vary at each level depending on the degree of drying already reached at this level by the fruit. Since the fruit is naturally drier and drier as it descends from belt 1 to belt 5, openings 20, 21, 22, 23 and 24 have to be provided with a progressively diminishing cross-section from top to bottom whilst, on the contrary, openings 27, 28, 29, 30 and 31 have increasing sizes. These sizes, or the ratio of the cross-sections at each level, can be determined by calculation and it is naturally possible to provide an adjustment means.

To sum up, the appliance is controlled exclusively, therefore, by acting on the setting of the single thermostat 35 located downstream of air heater 14 and in the second place by acting on the speed of travel of the belts so as to modify the residence time of the fruit in the appliance, depending on the kind of fruit involved and above all on the degree of dehydration required. Finally, it is also possible to adjust the air recycling rate by means of a damper controlling opening 32.

So, thanks to the invention, simplification of the equipment, energy savings, increased setting versatility, and the blowing of air into each level which can be adapted to the changing conditions of each of the levels in the optimum way have all been achieved simultaneously. The result is therefore both an improvement in the quality of the products leaving and of the productivity of the whole unit.

I claim:

1. A method for continuous dehydration of agricultural products in an enclosed housing, comprising sending said products continuously into said housing and moving them horizontally from one end to the other at the upper end of the housing, then dropping them to a lower level and sending them back at a lower horizontal layer and so on from level to level, and withdrawing the products from said housing from the lowest level, while blowing hot air in toward a central portion of the housing, collecting the blown air as two separate streams for partial recycling, heating one said stream only, while also taking in fresh air for that stream, distributing the air mixture of that stream at each said level, the second stream also being distributed to the various levels but without reheating, the area ratio of the first stream to the second stream constantly diminishing from the top level down to the bottom level.

2. The method of claim 1, including thermostatically controlling the heat of the air and adjusting the speeds of passage of the products in accordance with the type of products and degree of dehydration required.

3. A device for the continuous dehydration of agricultural products, comprising an enclosing housing having a central portion, side walls and end walls, a stack of endless belts inside said housing travelling horizontally, with the belts arranged from top to bottom so that there is an uppermost endless belt, intermediate endless belts, and a lowermost endless belt, each belt below the uppermost traveling in the opposite direction, the end of each belt being offset with respect to the beginning of the belt immediately above it to ensure that the products coming off the higher belt are picked up by the next lower belt, a pair of blowing means inside said housing above said uppermost belt for blowing hot air in toward said central portion near the middle of the belt lengths, first and second ducts for collecting said air as two separate streams for partial recycling, only one of said ducts being provided with heating means for reheating one said stream and with a fresh air intake and outlet means from said ducts for distributing at each belt level a mixture of a portion of air coming from the stream having the heating means through a first outlet opening, another portion of air coming from the stream without reheating through a second outlet opening, the ratio of the cross-sectional area of said first outlet opening to that of the second outlet opening constantly diminishing from the top level down to the bottom level.

4. The device according to claim 3, characterized in that the number of belts is odd, so that intake and discharge of the products is through opposite end walls of the housing.

5. The device according to claim 4, characterized in that the top belt is extended outside the housing through an intake opening made in one end wall of the housing and through which the products are input, being loaded onto the projecting part of the belt.

6. The device according to claim 5, characterized in that the bottom belt extends outside the housing through a discharge opening made in another end wall and through which the dehydrated products are discharged.

7. The device according to claim 5, characterized in that a top partition of said housing bounds the upper ends of the ducts of the two air circuits and extends to the intake opening and in that the drying air finally arriving at the corresponding end wall of the housing is discharged directly outside for the top belt through this intake opening, whilst for the other levels the air is conveyed through lateral vertical said ducts and upper side openings to an uppermost said duct circumventing the top belt.

8. The device according to claim 7, characterized in that each of the belts is made up of transverse metal sections fixed at each of their ends onto side chains which run round end sprockets.

9. The device according to claim 8 characterized in having thermostat means controlling the air heater and means for adjusting the speeds of the belts in accordance with the type of products and degree of dehydration required.

* * * * *